US010419867B2

(12) United States Patent
Seo et al.

(10) Patent No.: US 10,419,867 B2
(45) Date of Patent: Sep. 17, 2019

(54) DEVICE AND METHOD FOR PROCESSING AUDIO SIGNAL

(71) Applicant: GAUDIO LAB, INC., Los Angeles, CA (US)

(72) Inventors: Jeonghun Seo, Seoul (KR); Taegyu Lee, Seoul (KR); Hyun Oh Oh, Seongnam-si (KR)

(73) Assignee: GAUDIO LAB, INC., Los Angels, CA (US)

( * ) Notice: Subject to any disclaimer, the term of this patent is extended or adjusted under 35 U.S.C. 154(b) by 0 days.

(21) Appl. No.: 16/034,373

(22) Filed: Jul. 13, 2018

(65) Prior Publication Data

US 2018/0324542 A1 Nov. 8, 2018

Related U.S. Application Data

(63) Continuation of application No. PCT/KR2017/000633, filed on Jan. 19, 2017.

(30) Foreign Application Priority Data

Jan. 19, 2016 (KR) ..... 10-2016-0006650

(51) Int. Cl.
*H04R 5/033* (2006.01)
*H04S 3/00* (2006.01)
(Continued)

(52) U.S. Cl.
CPC ..... *H04S 7/303* (2013.01); *H04R 5/02* (2013.01); *H04R 5/033* (2013.01); *H04S 3/00* (2013.01);
(Continued)

(58) Field of Classification Search
CPC ..... H04R 5/02; H04R 5/033; H04S 2400/01; H04S 2400/11; H04S 2420/01;
(Continued)

(56) References Cited

U.S. PATENT DOCUMENTS

2005/0179701 A1 8/2005 Jahnke
2010/0246832 A1 9/2010 Villemoes et al.
(Continued)

FOREIGN PATENT DOCUMENTS

KR 10-2010-0049555 A 5/2010
KR 10-2015-0013913 A 2/2015
WO 2015/142073 A1 9/2015

OTHER PUBLICATIONS

International Search Report and Written Opinion of the International Searching Authority dated May 23, 2017 for Application No. PCT/KR2017/000633.

*Primary Examiner* — Vivian C Chin
*Assistant Examiner* — Friedrich Fahnert
(74) *Attorney, Agent, or Firm* — Park, Kim & Suh, LLC

(57) ABSTRACT

The present invention relates to an apparatus and a method for processing an audio signal, and more particularly, to an apparatus and a method for efficiently rendering a higher order ambisonics signal. To this end, provided are an audio signal processing apparatus, including: a pre-processor configured to separate an input audio signal into a first component corresponding to at least one object signal and a second component corresponding to a residual signal and extract position vector information corresponding to the first component from the input audio signal; a first rendering unit configured to perform an object-based first rendering on the first component using the position vector information; and a second rendering unit configured to perform a channel-based second rendering on the second component and an audio signal processing method using the same.

24 Claims, 5 Drawing Sheets

(51) Int. Cl.
*H04R 5/02* (2006.01)
*H04S 7/00* (2006.01)

(52) U.S. Cl.
CPC ..... *H04S 3/008* (2013.01); *H04S 2400/01* (2013.01); *H04S 2400/11* (2013.01); *H04S 2420/01* (2013.01); *H04S 2420/11* (2013.01)

(58) Field of Classification Search
CPC ..... H04S 2420/11; H04S 3/00; H04S 3/008; H04S 7/303
USPC ..... 381/17, 18, 300, 303
See application file for complete search history.

(56) References Cited

U.S. PATENT DOCUMENTS

2014/0119581 A1* 5/2014 Tsingos ..... H04S 3/008 381/300
2014/0133683 A1* 5/2014 Robinson ..... H04S 3/008 381/303
2015/0154965 A1* 6/2015 Wuebbolt ..... G10L 19/008 704/500
2015/0271620 A1* 9/2015 Lando ..... H04S 5/005 381/18
2016/0007132 A1* 1/2016 Peters ..... G10L 19/008 381/17
2017/0019746 A1* 1/2017 Oh ..... H04S 3/008
2017/0265016 A1* 9/2017 Oh ..... H04S 7/303
2017/0295446 A1* 10/2017 Thagadur Shivappa ..... H04S 7/304
2017/0366913 A1* 12/2017 Stein ..... H04S 3/008

* cited by examiner

DEVICE AND METHOD FOR PROCESSING AUDIO SIGNAL

CROSS-REFERENCE TO RELATED APPLICATIONS

This application claims the benefit under 35 U.S.C. § 120 and § 365(c) to a prior PCT International Application No. PCT/KR2017/000633, filed on Jan. 19, 2017, which claims the benefit of Korean Patent Application No. 10-2016-0006650, filed on Jan. 19, 2016, the entire contents of which are incorporated herein by reference.

TECHNICAL FIELD

The present invention relates to an apparatus and a method for processing an audio signal, and more particularly, to an apparatus and a method for efficiently rendering a higher order ambisonics signal.

BACKGROUND ART 3D audio collectively refers to a series of signal processing, transmitting, coding, and reproducing technologies which provide another axis corresponding to a height direction to a sound scene on a horizontal surface (2D) which is provided from surrounding audio of the related art to provide sound having presence in a three dimensional space. Specifically, in order to provide 3D audio, a larger number of speakers need to be used as compared than the related art or a rendering technique which forms a sound image in a virtual position where no speaker is provided even though a small number of speakers are used is required.

The 3D audio may be an audio solution corresponding to an ultra high definition TV (UHDTV) and is expected to be used in various fields and devices. There are channel-based signals and object-based signals as a sound source which is provided to the 3D audio. In addition, there may be a sound source in which the channel-based signals and the object-based signals are mixed and thus a user may have a new type of listening experience.

On the other hand, higher order ambisonics (HOA) may be used as a technique for providing scene-based immersive sound. The HOA is able to reproduce an entire audio scene in a compact and optimal state, thus providing high quality three-dimensional sound. The HOA technique may be useful in virtual reality (VR) where it is important to provide an immersive sound. However, while the HOA has an advantage of reproducing the entire audio scene, it has a disadvantage in that the performance of accurately representing positions of individual sound objects within an audio scene is deteriorated.

DISCLOSURE

Technical Problem

The present invention has an object to improve a rendering performance of an HOA signal in order to provide a more realistic immersive sound.

In addition, the present invention has an object to efficiently perform binaural rendering on an audio signal.

In addition, the present invention has an object to implement an immersive binaural rendering on an audio signal of virtual reality contents.

Technical Solution

In order to obtain the above object, the present invention provides an audio signal processing method and an audio signal processing apparatus as follows.

An exemplary embodiment of the present invention provides an audio signal processing apparatus, including: a pre-processor configured to separate an input audio signal into a first component corresponding to at least one object signal and a second component corresponding to a residual signal and extract position vector information corresponding to the first component from the input audio signal; a first rendering unit configured to perform an object-based first rendering on the first component using the position vector information; and a second rendering unit configured to perform a channel-based second rendering on the second component.

Furthermore, an exemplary embodiment of the present invention provides an audio signal processing method, including: separating an input audio signal into a first component corresponding to at least one object signal and a second component corresponding to a residual signal; extracting position vector information corresponding to the first component from the input audio signal; performing an object-based first rendering on the first component using the position vector information; and performing a channel-based second rendering on the second component.

The input audio signal may comprise higher order ambisonics (HOA) coefficients, and the pre-processor may decompose the HOA coefficients into a first matrix representing a plurality of audio signals and a second matrix representing position vector information of each of the plurality of audio signals, and the first rendering unit may perform an object-based rendering using position vector information of the second matrix corresponding to the first component.

The first component may be extracted from a predetermined number of audio signals in a high level order among a plurality of audio signals represented by the first matrix.

The first component may be extracted from audio signals having a level equal to or higher than a predetermined threshold value among a plurality of audio signals represented by the first matrix.

The first component may be extracted from coefficients of a predetermined low order among the HOA coefficients.

The pre-processor may perform a matrix decomposition of the HOA coefficients using singular value decomposition (SVD).

The first rendering may be an object-based binaural rendering, and the first rendering unit may perform the first rendering using a head related transfer function (HRTF) based on position vector information corresponding to the first component.

The second rendering may be a channel-based binaural rendering, and the second rendering unit may map the second component to at least one virtual channel and perform the second rendering using an HRTF based on the mapped virtual channel.

The first rendering unit may perform the first rendering by referring to spatial information of at least one object obtained from a video signal corresponding to the input audio signal.

The first rendering unit may modify at least one parameter related to the first component based on the spatial information obtained from the video signal, and perform an object-based rendering on the first component using the modified parameter.

Advantageous Effects

According to an exemplary embodiment of the present invention, it is possible to provide high-quality binaural sound with a low computational complexity.

In addition, according to the embodiment of the present invention, it is possible to prevent deterioration of sound localization and degradation of sound quality which may occur in a binaural rendering.

Further, according to the embodiment of the present invention, it is possible to implement rendering on an HOA signal in which sense of space and performance of sound image localization are improved with a low computational complexity.

MODE FOR INVENTION

Terminologies used in the specification are selected from general terminologies which are currently and widely used as much as possible while considering a function in the present invention, but the terminologies may vary in accordance with the intention of those skilled in the art, custom, or appearance of new technology. Further, in particular cases, the terminologies are arbitrarily selected by an applicant and in this case, the meaning thereof may be described in a corresponding section of the description of the invention. Therefore, it is noted that the terminology used in the specification is analyzed based on a substantial meaning of the terminology and the whole specification rather than a simple title of the terminology.

Throughout this specification and the claims that follow, when it is described that an element is "coupled" to another element, the element may be "directly coupled" to the other element or "electrically coupled" to the other element through a third element. Further, unless explicitly described to the contrary, the word "comprise" and variations such as "comprises" or "comprising", will be understood to imply the inclusion of stated elements but not the exclusion of any other elements. Moreover, limitations such as "or more" or "or less" based on a specific threshold may be appropriately substituted with "more than" or "less than", respectively.

Figure 1:
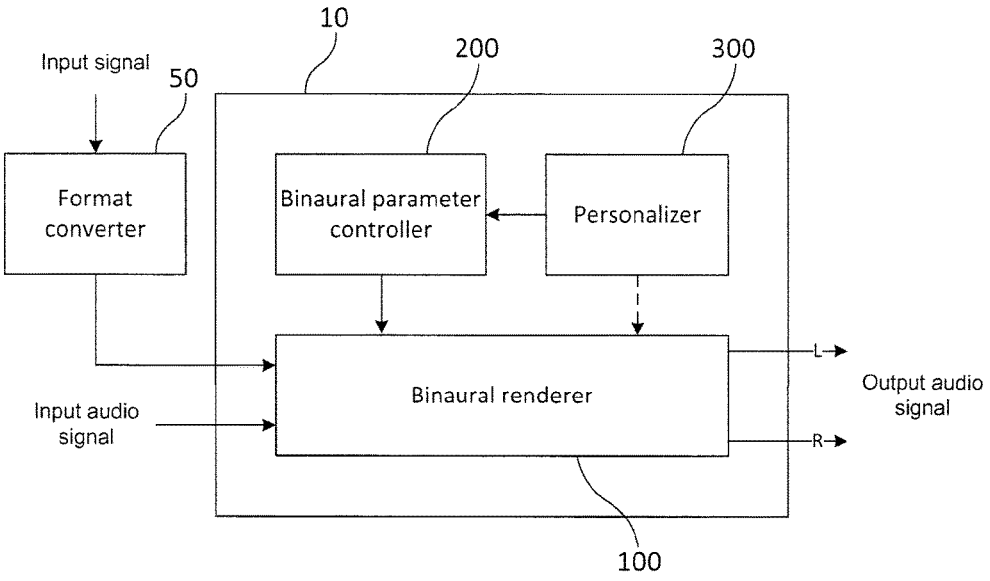
FIG. 1 is a block diagram illustrating an audio signal processing apparatus according to an exemplary embodiment of the present invention.

FIG. 1 is a block diagram illustrating an audio signal processing apparatus according to an exemplary embodiment of the present invention. Referring to FIG. 1, an audio signal processing apparatus 10 includes a binaural renderer 100, a binaural parameter controller 200, and a personalizer 300.

First, the binaural renderer 100 receives an input audio signal and performs binaural rendering on the input audio signal to generate two channel output audio signals L and R. The input audio signal of the binaural renderer 100 may include at least one of a loudspeaker channel signal, an object signal and an ambisonic signal. According to an exemplary embodiment, when the binaural renderer 100 includes a separate decoder, the input signal of the binaural renderer 100 may be a coded bitstream of the audio signal.

An output audio signal of the binaural renderer 100 is a binaural signal. The binaural signal is two channel audio signals in which each input audio signal is represented by a virtual sound source located in a 3D space. The binaural rendering is performed based on a binaural parameter provided from the binaural parameter controller 200 and performed on a time domain or a frequency domain. As described above, the binaural renderer 100 performs binaural rendering on various types of input signals to generate a 3D audio headphone signal (that is, 3D audio two channel signals).

According to an exemplary embodiment, post processing may be further performed on the output audio signal of the binaural renderer 100. The post processing includes crosstalk cancellation, dynamic range control (DRC), volume normalization, and peak limitation. The post processing may further include frequency/time domain transform on the output audio signal of the binaural renderer 100. The audio signal processing apparatus 10 may include a separate post processor which performs the post processing and according to another exemplary embodiment, the post processor may be included in the binaural renderer 100.

The binaural parameter controller 200 generates a binaural parameter for the binaural rendering and transfers the binaural parameter to the binaural renderer 100. In this case, the transferred binaural parameter includes an ipsilateral transfer function and a contralateral transfer function. In this case, the transfer function may include at least one of a head related transfer function (HRTF), an interaural transfer function (ITF), a modified ITF (MITF), a binaural room transfer function (BRTF), a room impulse response (RIR), a binaural room impulse response (BRIR), a head related impulse response (HRIR), and modified/edited data thereof, but the present invention is not limited thereto.

According to an embodiment of the present invention, the binaural parameter controller 200 may obtain the transfer function from a database (not illustrated). According to another embodiment of the present invention the binaural parameter controller may receive a personalized transfer function from the personalizer 300. In the present invention, it is assumed that the transfer function is obtained by performing fast Fourier transform on an impulse response (IR), but a transform method in the present invention is not limited thereto. That is, according to the exemplary embodiment of the present invention, the transform method includes a quadrature mirror filter (QMF), discrete cosine transform (DCT), discrete sine transform (DST), and wavelet.

According to an exemplary embodiment of the present invention, the binaural parameter controller 200 may generate the binaural parameter based on personalized information obtained from the personalizer 300. The personalizer 300 obtains additional information for applying different binaural parameters in accordance with users and provides the binaural transfer function determined based on the obtained additional information. For example, the personalizer 300 may select a binaural transfer function (for example, a personalized HRTF) for the user from the database, based on physical attribute information of the user. In this case, the physical attribute information may include information such as a shape or size of a pinna, a shape of external auditory meatus, a size and a type of a skull, a body type, and a weight.

The personalizer 300 provides the determined binaural transfer function to the binaural renderer 100 and/or the binaural parameter controller 200. According to an exemplary embodiment, the binaural renderer 100 performs the binaural rendering on the input audio signal using the binaural transfer function provided from the personalizer 300. According to another exemplary embodiment, the binaural parameter controller 200 generates a binaural parameter using the binaural transfer function provided from the personalizer 300 and transfers the generated binaural parameter to the binaural renderer 100. The binaural renderer 100 performs binaural rendering on the input audio signal based on the binaural parameter obtained from the binaural parameter controller 200.

According to the embodiment of the present invention, the input audio signal of the binaural renderer 100 may be obtained through a conversion process in a format converter 50. The format converter 50 converts an input signal recorded through at least one microphone into an object signal, an ambisonic signal, or the like. According to an embodiment, the input signal of the format converter 50 may be a microphone array signal. The format converter 50 obtains recording information including at least one of the arrangement information, the number information, the position information, the frequency characteristic information, and the beam pattern information of the microphones constituting the microphone array, and converts the input signal based on the obtained recording information. According to an embodiment, the format converter 50 may additionally obtain location information of a sound source, and may perform conversion of an input signal by using the information.

The format converter 50 may perform various types of format conversion as described below. For convenience of description, each format signal according to the embodiment of the present invention is defined as follows. A-format signal refers to a raw signal recorded in a microphone (or microphone array). The recorded raw signal may be a signal of which gain or delay is not modified. B-format signal refers to an ambisonic signal. In the exemplary embodiment of the present invention, the ambisonic signal represents a first order ambisonics (FOA) signal or a higher order ambisonics (HOA) signal.

<A2B Conversion (Conversion of A-Format Signal to B-Format Signal)>

A2B conversion refers to a conversion from an A-format signal to a B-format signal. According to the embodiment of the present invention, the format converter 50 may convert a microphone array signal into an ambisonic signal. The position of each microphone of a microphone array on the spherical coordinate system may be expressed by a distance from the center of the coordinate system, azimuth angle (or horizontal angle) θ, and altitude angle (or vertical angle) ϕ. The basis of a spherical harmonic function may be obtained through the coordinate value of each microphone in the spherical coordinate system. The microphone array signal is projected to a spherical harmonic function domain based on each basis of the spherical harmonic function.

For example, the microphone array signal may be recorded through a spherical microphone array. When the center of the spherical coordinate system is matched with the center of the microphone array, the distance from the center of the microphone array to each microphone is constant, so that the position of each microphone may be represented only by an azimuth angle and an altitude angle. More specifically, when the position of the q-th microphone in the microphone array is (θq, ϕq), a signal Sq recorded through the corresponding microphone may be expressed by the following equation in the spherical harmonic function domain.

$$S_q = \sum_{m=0}^{\infty} W_m(kR) \sum_{n=0}^{m} \sum_{\sigma=\pm 1} B_{mn}^{\sigma} Y_{mn}^{\sigma}(\theta_q, \phi_q) \quad \text{[Equation 1]}$$

Herein, Y denotes a basis function of the spherical harmonic function, and B denotes ambisonic coefficients corresponding to the basis function. In the embodiment of the present invention, an ambisonic signal (or an HOA signal) may be used as a term referring to the ambisonic coefficients (or HOA coefficients). k denotes the wave number, and R denotes a radius of the spherical microphone array. Wm (kR) denotes a radian filter for the m-th order ambisonic coefficient. σ denotes the degree of the basis function and has a value of +1 or −1.

When the number of microphones in the microphone array is L, a maximum of M-th order ambisonic signal can be obtained. In this case, M=floor(sqrt(L))−1. Further, the M-th order ambisonic signal is composed of a total of $K=(M+1)^2$ ambisonic channel signals. The above Equation 1 may be expressed by the following Equation 2 when expressed by a discrete Matrix. In this case, the definition of each variable in Equation 2 is as shown in Equation 3.

$$T \cdot b = s \quad \text{[Equation 2]}$$

$$T = \begin{pmatrix} Y_{00}^{1}(\theta_1, \phi_1) & \cdots & Y_{MM}^{1}(\theta_1, \phi_1) \\ \vdots & \ddots & \vdots \\ Y_{00}^{1}(\theta_Q, \phi_Q) & \cdots & Y_{MM}^{1}(\theta_Q, \phi_Q) \end{pmatrix} \cdot \mathrm{diag}[W_m(kR)] \quad \text{[Equation 3]}$$

$$s = (S_1, S_2, \cdots, S_Q)^T,$$

$$b = (B_{00}^{1}, B_{11}^{-1}, B_{10}^{1}, B_{11}^{1}, \cdots, B_{MM}^{1})^T$$

Herein, T is a conversion matrix of a size of Q×K, b is a column vector of a length of K, and s is a column vector of a length of Q. Q is the total number of microphones constituting the microphone array, and q in the above Equation 1 satisfies 1≤q≤Q. Further, K is the total number of ambisonic channel signals constituting the M-th order ambisonic signal, and satisfies $K=(M+1)^2$. M denotes the highest order of the ambisonic signals, and m in the Equations 1 and Equation 3 satisfy 0≤m≤M.

Thus, the ambisonic signal b may be calculated as shown in Equation 4 below by using a pseudo inverse matrix of T. However, when the matrix T is a square matrix, $T^{-1}$ may be an inverse matrix instead of a pseudo-inverse matrix.

$$b = T^{-1} \cdot s \quad \text{[Equation 4]}$$

The ambisonic signal may be output by being converted to a channel signal and/or an object signal. A specific embodiment thereof will be described later. According to an embodiment, if a distance of the loudspeaker layout from which the converted signal is output is different from an initial set distance, a distance rendering may additionally be applied to the converted signal. Thus, it is possible to control the phenomenon that the HOA signal generated by assuming a plane wave reproduction is boosted by being reproduced as a spherical wave in a low frequency band due to a change of loudspeaker distance.

<Conversion of a Beam-Formed Signal to a Channel Signal or an Object Signal>

When adjusting the gain and/or delay of each microphone of the microphone array, a signal of a sound source existing in a specific direction can be beam-formed and received. In the case of audio visual (AV) contents, the direction of the sound source may be matched to position information of a specific object in a video. According to an embodiment, a signal of a sound source in a specific direction may be beam-formed and recorded, and the recorded signal may be output to a loudspeaker in the same direction. That is, at least a part of the signals may be steered and recorded by considering the loudspeaker layout of the final reproduction stage, and thus the recorded signal may be used as an output signal of a specific loudspeaker without a separate post processing. If a beamforming direction of the microphone array does not match a direction of the loudspeaker of the final reproduction stage, the recorded signal may be output to the speaker after a post-processing such as constant power panning (CPP), vector-based amplitude panning (VBAP), and the like is applied.

<Conversion of A-Format Signal to an Object Signal>

When using a linear combination of A-format signals, virtual steering can be performed in a post-processing step. In this case, the linear combination includes at least one of principal component analysis (PCA), non-negative matrix factorization (NMF), and deep neural network (DNN). The signals obtained from each microphone can be analyzed in a time-frequency domain and then subjected to virtual adaptive steering to be converted to a sound object corresponding to a recorded sound field.

Meanwhile, FIG. 1 is an exemplary embodiment illustrating a configuration of the audio signal processing apparatus 10 of the present invention, and the present invention is not limited thereto. For example, the audio signal processing apparatus 10 of the present invention may further include an additional element in addition to the configuration shown in FIG. 1. In addition, some elements shown in FIG. 1, for example, the personalizer 300 and the like may be omitted from the audio signal processing apparatus 10. Furthermore, the format converter 50 may be included as a part of the audio signal processing apparatus 10.

Figure 2:
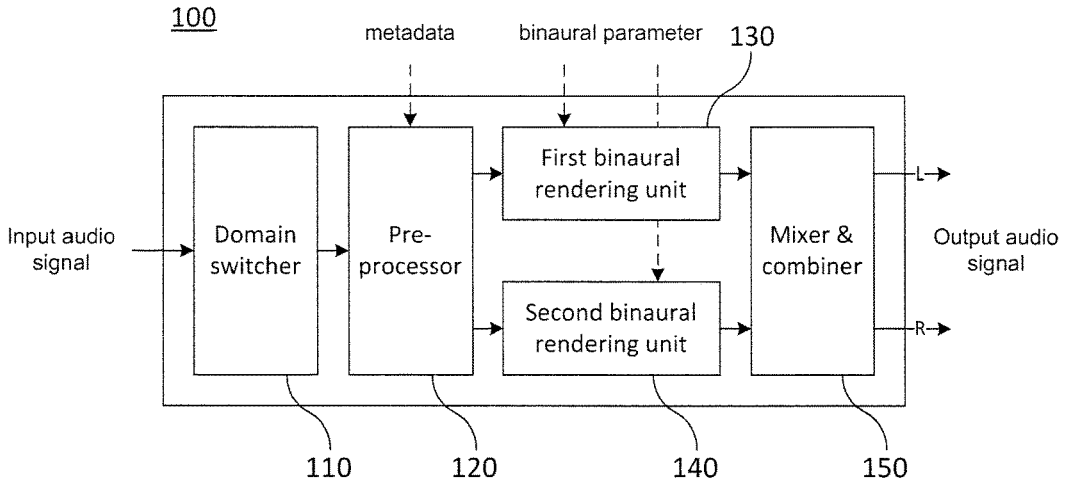
FIG. 2 is a block diagram illustrating a binaural renderer according to an exemplary embodiment of the present invention.

FIG. 2 is a block diagram illustrating a binaural renderer according to an exemplary embodiment of the present invention. Referring to FIG. 2, the binaural renderer 100 may include a domain switcher 110, a pre-processor 120, a first binaural rendering unit 130, a second binaural rendering unit 140, and a mixer & combiner 150. In the embodiment of the present invention, an audio signal processing apparatus may indicate the binaural renderer 100 of FIG. 2. However, in the embodiment of the present invention, an audio signal processing apparatus in a broad sense may indicate the audio signal processing apparatus 10 of FIG. 1 including the binaural renderer 100.

As described above, the binaural renderer 100 receives an input audio signal, and performs binaural rendering on the input audio signal to generate two channel output audio signals L and R. The input audio signal of the binaural renderer 100 may include at least one of a loudspeaker channel signal, an object signal, and an ambisonic signal. According to an embodiment of the present invention, an HOA signal may be received as the input audio signal of the binaural renderer 100.

The domain switcher 110 performs domain transform of an input audio signal of the binaural renderer 100. The domain transform may include at least one of a fast Fourier transform, an inverse fast Fourier transform, a discrete cosine transform, an inverse discrete cosine transform, a QMF analysis, and a QMF synthesis, but the present invention is not limited thereto. According to an exemplary embodiment, the input signal of the domain switcher 110 may be a time domain audio signal, and the output signal of the domain switcher 110 may be a subband audio signal of a frequency domain or a QMF domain. However, the present invention is not limited thereto. For example, the input audio signal of the binaural renderer 100 is not limited to a time domain audio signal, and the domain switcher 110 may be omitted from the binaural renderer 100 depending on the type of the input audio signal. In addition, the output signal of the domain switcher 110 is not limited to a subband audio signal, and different domain signals may be output depending on the type of the audio signal. According to a further embodiment of the present invention, one signal may be transformed to a plurality of different domain signals.

The pre-processor 120 performs a pre-processing for rendering an audio signal according to the embodiment of the present invention. According to the embodiment of the present invention, the audio signal processing apparatus may perform various types of pre-processing and/or rendering. For example, the audio signal processing apparatus may render at least one object signal as a channel signal. In addition, the audio signal processing apparatus may separate a channel signal or an ambisonic signal (e.g., HOA coefficients) into a first component and a second component. According to an embodiment, the first component represents an audio signal (i.e., an object signal) corresponding to at least one sound object. The first component is extracted from an original signal according to predetermined criteria. A specific embodiment thereof will be described later. Also, the second component is the residual component after the first component has been extracted from the original signal. The second component may represent an ambient signal and may also be referred to as a background signal. Further, according to an embodiment of the present invention, the audio signal processing apparatus may render all or a part of an ambisonic signal (e.g., HOA coefficients) as a channel signal. For this, the pre-processor 120 may perform various types of pre-processing such as conversion, decomposition, extraction of some components, and the like of an audio signal. For the pre-processing of the audio signal, separate metadata may be used.

When the pre-processing of the input audio signal is performed, it is possible to customize the corresponding audio signal. For example, when an HOA signal is separated into an object signal and an ambient signal, a user may increase or decrease a level of a specific object signal by multiplying the object signal by a gain greater than 1 or a gain less than 1. When an input audio signal is X and a conversion matrix is T, the converted audio signal Y can be expressed by the following equation.

$$Y=T\cdot X \qquad \text{[Equation 5]}$$

According to the embodiment of the present invention, the conversion matrix T may be determined based on a factor which is defined as a cost in the audio signal conversion process. For example, when the entropy of the converted audio signal Y is defined as a cost, a matrix minimizing the entropy may be determined as the conversion matrix T. In this case, the converted audio signal Y may be a signal advantageous for compression, transmission, and storage. Further, when the degree of cross-correlation between elements of the converted audio signal Y is defined as a cost, a matrix minimizing the degree of cross-correlation may be determined as the conversion matrix T. In this case, the converted audio signal Y has higher orthogonality among the elements, and it is easy to extract the characteristics of each element or to perform separate processing on specific elements.

The binaural rendering unit performs a binaural rendering on the audio signal that has been pre-processed by the pre-processor 120. The binaural rendering unit performs binaural rendering on the audio signal based on the transferred binaural parameters. The binaural parameters include an ipsilateral transfer function and a contralateral transfer function. The transfer function may include at least one of HRTF, ITF, MITF, BRTF, RIR, BRIR, HRIR, and modified/edited data thereof as described above in the embodiment of FIG. 1.

According to the embodiment of the present invention, the binaural renderer 100 may include a plurality of binaural rendering units 130 and 140 that perform different types of renderings. When the input audio signal is separated into the first component and the second component in the pre-processor 120, the separated first component may be processed in the first binaural rendering unit 130, and the separated second component may be processed in the second binaural rendering unit 140. According to an embodiment, the first binaural rendering unit 130 may perform an object-based binaural rendering. The first binaural rendering unit 130 filters the input object signal using a transfer function corresponding to a position of the corresponding object. In addition, the second binaural rendering unit 140 may perform a channel-based binaural rendering. The second binaural rendering unit 140 filters the input channel signal using a transfer function corresponding to the position of the corresponding channel. A specific embodiment thereof will be described later.

The mixer & combiner 160 combines the signal rendered in the first binaural rendering unit 130 and the signal rendered in the second binaural rendering unit 140 to generate an output audio signal. When the binaural rendering is performed in the QMF domain, the binaural renderer 100 may QMF synthesize the signal combined in the mixer & combiner 160 to generate an output audio signal in the time domain.

The binaural renderer 100 shown in FIG. 2 is a block diagram according to an exemplary embodiment of the present invention, in which blocks shown separately logically distinguish the elements of a device. Thus, the elements of the device described above can be mounted as one chip or as a plurality of chips depending on the design of the device. For example, the first binaural rendering unit 130 and the second binaural rendering unit 140 may be integrated into one chip or may be implemented as separate chips.

Meanwhile, although the binaural rendering method of an audio signal has been described with reference to FIGS. 1 and 2, the present invention may be extended to a rendering method of an audio signal for loudspeaker output. In this case, the binaural renderer 100 and the binaural parameter controller 200 of FIG. 1 may be replaced with a rendering apparatus and a parameter controller, respectively, and the first binaural rendering unit 130 and the second binaural rendering unit 140 of FIG. 2 may be replaced with a first rendering unit and a second rendering unit, respectively.

That is, according to the embodiment of the present invention, a rendering apparatus of an audio signal may include a first rendering unit and a second rendering unit that perform different types of rendering. The first rendering unit performs a first rendering on a first component separated from the input audio signal, and the second rendering unit performs a second rendering on a second component separated from the input audio signal. According to an embodiment, the first rendering may be an object-based rendering and the second rendering may be a channel-based rendering. In the following description, various embodiments of a pre-processing method and a binaural rendering method of an audio signal are described, but the present invention may also be applied to a rendering method of an audio signal for a loudspeaker output.

<O2C Conversion/O2B Conversion>

O2C conversion refers to a conversion from an object signal to a channel signal, and O2B conversion refers to a conversion from an object signal to a B-format signal. The object signal may be distributed to channel signals having a predetermined loudspeaker layout. More specifically, the object signal may be distributed by reflecting gains to channel signals of loudspeakers adjacent to the position of the object. According to an embodiment, vector based amplitude panning (VBAP) may be used.

<C2O Conversion/B2O Conversion>

C2O conversion refers to a conversion from a channel signal to an object signal, and B2O conversion refers to a conversion from a B-format signal to an object signal. A blind source separation technique may be used to convert a channel signal or a B-format signal into an object signal. The blind source separation technique includes principal component analysis (PCA), non-negative matrix factorization (NMF), deep neural network (DNN), and the like. As described above, the channel signal or the B-format signal may be separated into a first component and a second component. The first component may be an object signal corresponding to at least one sound object. Also, the second component may be the residual component after the first component has been extracted from the original signal.

According to the embodiment of the present invention, HOA coefficients may be separated into a first component and a second component. The audio signal processing apparatus performs different renderings on the separated first component and the second component. First, when a matrix decomposition of HOA coefficients matrix H is performed, it can be expressed as U, S and V matrices as shown in Equation 6 below.

$$\begin{aligned} H &= USV^T \quad \text{, where } N_f <= (O+1)\hat{}2 \\ &= \sum_{i=1}^{(O+1)\hat{}2} us_i v_i^T \\ &= \sum_{i=1}^{N_f} us_i v_i^T + B.G. \end{aligned} \qquad \text{[Equation 6]}$$

Herein, U is a unitary matrix, S is a non-negative diagonal matrix, and V is a unitary matrix. O represents the highest order of the HOA coefficients matrix H (i.e., ambisonic signal). $us_i$ which is the product of the column vectors U and S represents the i-th object signal, and the column vector $v_i$ of V represents position information (i.e., spatial characteristic) of the i-th object signal. That is, the HOA coefficients matrix H may be decomposed into a first matrix US representing a plurality of audio signals and a second matrix V representing position vector information of each of the plurality of audio signals.

The matrix decomposition of HOA coefficients implies reduction of matrix dimension of the HOA coefficients or matrix factorization of the HOA coefficients. According to an embodiment of the present invention, the matrix decomposition of the HOA coefficients may be performed using singular value decomposition (SVD). However, the present invention is not limited thereto, and a matrix decomposition using PCA, NMF, or DNN may be performed depending on the type of the input signal. The pre-processor of the audio signal processing apparatus performs matrix decomposition of the HOA coefficients matrix H as described above. According to the embodiment of the present invention, the pre-processor may extract position vector information corresponding to the first component of the HOA coefficients from the decomposed matrix V. The audio signal processing apparatus performs an object-based rendering on the first component of the HOA coefficients using the extracted position vector information.

The audio signal processing apparatus may separate the HOA coefficients into the first component and the second component according to various embodiments. In the above Equation 6, when the size of $us_i$ is larger than a certain level, the corresponding signal may be regarded as an audio signal of an individual sound object located at $v_i$. However, when the size of $us_i$ is smaller than a certain level, the corresponding signal may be regarded as an ambient signal.

According to an embodiment of the present invention, the first component may be extracted from a predetermined number $N_f$ of audio signals in a high level order among a plurality of audio signals represented by the first matrix US. According to an embodiment, in the U, S and V matrices after matrix decomposition is performed, the audio signal $us_i$ and the position vector information $v_i$ may be arranged in order of the level of the corresponding audio signal. In this case, the first component may be extracted from the audio signals from i=1 to $i=N_f$ as in the Equation 6. When the highest order of the HOA coefficients is O, the corresponding ambisonic signals consist of a total of $(O+1)^2$ ambisonic channel signals. $N_f$ is set to a value less than or equal to the total number $(O+1)^2$ of ambisonic channel signals. Preferably, $N_f$ may be set to a value less than $(O+1)^2$. According to the embodiment of the present invention, $N_f$ may be adjusted based on complexity-quality control information.

The audio signal processing apparatus performs the object-based rendering on audio signals less than the total number of ambisonic channels, thereby performing an efficient operation.

According to another embodiment of the present invention, the first component may be extracted from audio signals having a level equal to or higher than a predetermined threshold value among a plurality of audio signals represented by the first matrix US. The number of audio signals extracted as the first component may vary according to the threshold value.

The audio signal processing apparatus performs the object-based rendering on the signal $us_i$ extracted as the first component using the position vector $v_i$ corresponding thereto. According to the embodiment of the present invention, an object-based binaural rendering on the first component may be performed. In this case, the first rendering unit (i.e., the first binaural rendering unit) of the audio signal processing apparatus may perform a binaural rendering on the audio signal $us_i$ using an HRTF based on the position vector $v_i$.

According to yet another embodiment of the present invention, the first component may be extracted from coefficients of a predetermined low order among the input HOA coefficients. For example, when the highest order of the input HOA coefficients is 4, the first component may be extracted from the 0th and 1st order HOA coefficients. The HOA coefficients of the low order may reflect a signal of a dominant sound object. The audio signal processing apparatus performs the object-based rendering on the low order HOA coefficients using the position vector $v_i$ corresponding thereto.

On the other hand, the second component indicates the residual signal after the first component has been extracted from the input HOA coefficients. The second component may represent an ambient signal, and may be referred to as a background (B.G.) signal. The audio signal processing apparatus performs the channel-based rendering on the second component. More specifically, the second rendering unit of the audio signal processing apparatus maps the second component to at least one virtual channel and outputs the signal as a signal of the mapped virtual channel(s). According to the embodiment of the present invention, a channel-based binaural rendering on the second component may be performed. In this case, the second rendering unit (i.e., the second binaural rendering unit) of the audio signal processing apparatus may map the second component to at least one virtual channel, and perform the binaural rendering on the second component using an HRTF based on the mapped virtual channel. A specific embodiment of the channel-based rendering on the HOA coefficients will be described later.

According to a further embodiment of the present invention, the audio signal processing apparatus may perform the channel-based rendering only on a part of signals of the second component for efficient operation. More specifically, the second rendering unit (or the second binaural rendering unit) of the audio signal processing apparatus may perform the channel-based rendering only on coefficients that are equal to or less than a predetermined order among the second component. For example, when the highest order of the input HOA coefficients is 4, the channel-based rendering may be performed only on coefficients equal to or less than the 3rd order. The audio signal processing apparatus may not perform a rendering for coefficients exceeding a predetermined order (for example, 4th order) among the input HOA coefficients.

As described above, the audio signal processing apparatus according to the embodiment of the present invention may perform a complex rendering on the input audio signal. The pre-processor of the audio signal processing apparatus separates the input audio signal into the first component corresponding to at least one object signal and the second component corresponding to the residual signal. Further, the pre-processor decomposes the input audio signal into the first matrix US representing a plurality of audio signals and the second matrix V representing position vector information of each of the plurality of audio signals. The pre-processor may extract the position vector information corresponding to the separated first component from the second matrix V. The first rendering unit (or the first binaural rendering unit) of the audio signal processing apparatus performs the object-based rendering on the first component using the position vector information $v_i$ of the second matrix V corresponding to the first component. In addition, the second rendering unit (or the second binaural rendering unit) of the audio signal processing apparatus performs the channel-based rendering on the second component.

In the case of an artificially synthesized audio signal, the relative position of the sound source around the listener can be easily obtained by using the characteristics of the signal (for example, known spectrum information of the original signal) or the like. Thus, individual sound objects can be easily extracted from the HOA signal. According to an embodiment of the present invention, the positions of the individual sound objects may be defined using metadata such as predetermined spatial information and/or video information. Meanwhile, in the case of an audio signal recorded through a microphone, the matrix V can be estimated using NMF, DNN, or the like. In this case, the pre-processor may estimate the matrix V more accurately by using separate metadata such as video information.

As described above, the audio signal processing apparatus may perform the conversion of the audio signal using the metadata. In this case, the metadata includes information of a non-audio signal such as a video signal. For example, when 360 video is recorded, position information of a specific object can be obtained from the corresponding video signal. The pre-processor may determine the conversion matrix T of Equation 5 based on the position information obtained from the video signal. The conversion matrix T may be determined by an approximated equation depending on the position of a specific object. In addition, the audio signal processing apparatus may reduce the processing amount for the pre-processing by using the approximated equation after loading it into the memory in advance.

A specific embodiment for performing the object-based rendering using video information is as follows. According to the embodiment of the present invention, an object signal may be extracted from an input HOA signal by referring to information of a video signal corresponding to the input HOA signal. First, the audio signal processing apparatus matches the spatial coordinate system of the video signal with the spatial coordinate system of the HOA signal. For example, azimuth angle 0 and altitude angle 0 of the 360 video signal can be matched with azimuth angle 0 and altitude angle 0 of the HOA signal. In addition, the geo-location of the 360 video signal and the HOA signal can be matched. After such a matching is performed, the 360 video signal and the HOA signal may share rotation information such as yaw, pitch, and role.

According to the embodiment of the present invention, one or more candidate dominant visual objects (CDVOs) may be extracted from the video signal. In addition, one or more candidate dominant audio objects (CDAOs) may be extracted from the HOA signal. The audio signal processing apparatus determines a dominant visual object (DVO) and a dominant audio object (DAO) by cross-referencing the CDVO and the CDAO. The ambiguity of the candidate objects may be calculated as a probability value in the process of extracting the CDVO and the CDAO. The audio signal processing apparatus may determine the DVO and the DAO through an iterative process of comparing and using each ambiguity probability value.

According to an embodiment, the CDVO and the CDAO may not correspond 1 to 1. For example, an audio object that does not have a visual object, such as a wind sound may be present. Further, a visual object that does not have a sound, such as a tree, a sun, or the like may be present. According to the embodiment of the present invention, a dominant object in which a visual object and an audio object are matched with is referred to as a dominant audio-Visual object (DAVO). The audio signal processing apparatus may determine the DAVO by cross-referencing the CDVO and the CDAO.

The audio signal processing apparatus may perform the object-based rendering by referring to spatial information of at least one object obtained from the video signal. The spatial information of the object includes position information of the object, and size (or volume) information of the object. In this case, the spatial information of at least one object may be obtained from any one of CDVO, DVO, or DAVO. More specifically, the first rendering unit of the audio signal processing apparatus may modify at least one parameter related to the first component based on the spatial information obtained from the video signal. The first rendering unit performs the object-based rendering on the first component using the modified parameter.

More specifically, the audio signal processing apparatus may precisely obtain position information of a moving object by referring to trajectory information of the CDVO and/or trajectory information of the CDAO. The trajectory information of the CDVO may be obtained by referring to position information of the object in the previous frame of the video signal. Further, the size information of the CDAO may be determined or modified by referring to the size (or volume) information of the CDVO. The audio signal processing apparatus may perform the rendering based on the size information of the audio object. For example, the HOA parameter such as a beam width for the corresponding object may be changed based on the size information of the audio object. In addition, binaural rendering which reflects the size of the corresponding object may be performed based on the size information of the audio object. The binaural rendering which reflects the size of the object may be performed through control of the auditory width. As a method of controlling the auditory width, there are a method of performing binaural rendering corresponding to a plurality of different positions, a method of controlling the auditory width using a decorrelator, and the like.

As described above, the audio signal processing apparatus may improve the performance of the object-based rendering by referring to the spatial information of the object obtained from the video signal. That is, the extraction performance of the first component corresponding to the object signal within the input audio signal may be improved.

<B2C Conversion>

B2C conversion refers to a conversion from a B-format signal to a channel signal. A loudspeaker channel signal may be obtained through matrix conversion of the ambisonic signal. When the ambisonic signal is b and the loudspeaker channel signal is I, the B2C conversion may be expressed by Equation 7 below.

$$l = D \cdot b \qquad \text{[Equation 7]}$$

The decoding matrix D is a pseudo-inverse or inverse matrix of a matrix C that converts the loudspeaker channel into a spherical harmonic function domain, and can be expressed by Equation 8 below. Herein, N denotes the number of loudspeaker channels (or virtual channels), and the definitions of the remaining variables are as described in Equation 1 through Equation 3.

$$D = C^{-1} = \begin{pmatrix} Y_{00}^{1}(\theta_1, \phi_1) & \cdots & Y_{MM}^{1}(\theta_N, \phi_N) \\ \vdots & \ddots & \vdots \\ Y_{00}^{1}(\theta_1, \phi_1) & \cdots & Y_{MM}^{1}(\theta_N, \phi_N) \end{pmatrix}^{-1} \qquad \text{[Equation 8]}$$

According to the embodiment of the present invention, the B2C conversion may be performed only on a part of the input ambisonic signal. As described above, the ambisonic signals (i.e., HOA coefficients) may be separated into the first component and the second component. In this case, the channel-based rendering may be performed on the second component. When the input ambisonic signal is $b_{original}$ and the first component is $b_{Nf}$, then the second component $b_{residual}$ may be obtained as shown in Equation 9.

$$b_{residual}=b_{original}-b_{Nf} \quad \text{[Equation 9]}$$

Herein, the second component $b_{residual}$ denotes the residual signal after the first component $b_{Nf}$ has been extracted from the input ambisonic signal $b_{original}$, which is also an ambisonic signal. In the same manner as in Equations 7 and 8, the channel-based rendering on the second component $b_{residual}$ may be performed as Equation 10 below.

$$l_{virtual}=D\cdot b_{residual} \quad \text{[Equation 10]}$$

Herein, D is as defined in Equation 8.

That is, the second rendering unit of the audio signal processing apparatus may map the second component $b_{residual}$ to N virtual channels, and output the signal as the signals of the mapped virtual channels. The positions of the N virtual channels may be $(r_1, \theta_1, \phi_1), \ldots, (r_N, \theta_N, \phi_N)$. However, when converting the ambisonic signal into the virtual channel signal, assuming that the distances from the reference point to the respective virtual channels are all the same, the positions of the N virtual channels may be expressed as $(\theta_1, \phi_1), \ldots, (\theta_N, \phi_N)$. According to the embodiment of the present invention, the channel-based binaural rendering for the second component may be performed. In this case, the second rendering unit (i.e., the second binaural rendering unit) of the audio signal processing apparatus may map the second component to N virtual channels, and perform the binaural rendering on the second component using HRTFs based on the mapped virtual channels.

According to a further embodiment of the present invention, the audio signal processing apparatus may perform a B2C conversion and a rotation transform of the input audio signal together. In case that a position of an individual channel is represented by azimuth angle θ and altitude angle φ, the corresponding position may be expressed by Equation 11 below when it is projected on a unit sphere.

$$\Gamma = \begin{pmatrix} \cos\theta\cos\phi \\ \sin\theta\cos\phi \\ \sin\phi \end{pmatrix} \quad \text{[Equation 11]}$$

When a rotation value around the x-axis is α, a rotation value around the y-axis is β, and a rotation value around the z-axis is γ, then the position of the individual channel after the rotation transform may be expressed by Equation 12 below.

$$\tilde{\Gamma} = R(\alpha, \beta, \gamma)\Gamma \quad \text{[Equation 12]}$$

$$= \underbrace{\begin{pmatrix} 1 & 0 & 0 \\ 0 & \cos\alpha & -\sin\alpha \\ 0 & \sin\alpha & \cos\alpha \end{pmatrix}}_{x\text{-axis-rotation}} \underbrace{\begin{pmatrix} \cos\beta & 0 & \sin\beta \\ 0 & 1 & 0 \\ -\sin\beta & 0 & -\cos\beta \end{pmatrix}}_{y\text{-axis-rotation}}$$

$$\underbrace{\begin{pmatrix} \cos\gamma & -\sin\gamma & 0 \\ \sin\gamma & \cos\gamma & 0 \\ 0 & 0 & 1 \end{pmatrix}}_{z\text{-axis-rotation}} \begin{pmatrix} \cos\theta\cos\phi \\ \cos\theta\sin\phi \\ \sin\phi \end{pmatrix}$$

The audio signal processing apparatus may obtain an adjusted position (θ', φ') of the individual channel after the rotation transform and determine the B2C conversion matrix D based on the adjusted position (θ', φ').

<Binaural Rendering Based on a Sparse Matrix>

The binaural rendering on the input audio signal may be performed through a filtering using a BRIR filter corresponding to the location of a particular virtual channel. When the input audio signal is converted by the preprocessor as in the above-described embodiments, the input audio signal may be represented by X, the conversion matrix may be represented by T, and the converted audio signal may be represented by Y, as shown in Equation 5. When a BRIR filter (i.e., the BRIR matrix) corresponding to the converted audio signal Y is $H_Y$, a binaural rendered signal $B_Y$ of Y may be expressed by Equation 13 below.

$$B_Y=\text{conv}(H_Y,Y)=\text{conv}(H_Y,T\cdot X)=\text{conv}(H_Y\cdot T,X) \quad \text{[Equation 13]}$$

Herein, conv(X, Y) denotes a convolution operation of X and Y. Meanwhile, when an inverse transform matrix from the converted audio signal Y to the input audio signal X is denoted by D, the following Equation 14 may be satisfied.

$$X=D\cdot Y \quad \text{[Equation 14]}$$

The matrix D may be obtained as a pseudo-inverse matrix (or an inverse matrix) of the conversion matrix T. When a BRIR filter corresponding to the input audio signal X is $H_X$, a binaural rendered signal $B_X$ of X may be expressed by Equation 15 below.

$$B_X=\text{conv}(H_X,X)=\text{conv}(H_X,D\cdot Y)=\text{conv}(H_X\cdot D,Y) \quad \text{[Equation 15]}$$

In the Equations 13 and 15 above, the conversion matrix T and the inverse transform matrix D may be determined according to the conversion type of the audio signal.

In the case of a conversion between a channel signal and an object signal, the matrix T and the matrix D may be determined based on VBAP. In the case of a conversion between an ambient signal and a channel signal, the matrix T and the matrix D may be determined based on the aforementioned B2C conversion matrix. In addition, when the audio signal X and the audio signal Y are channel signals having different loudspeaker layouts, the matrix T and the matrix D may be determined based on a flexible rendering technique or may be determined with reference to CDVO.

When the matrix T or the matrix D is a sparse matrix, $H_Y\cdot T$ or $H_X\cdot D$ may also be a sparse matrix. According to the embodiment of the present invention, the audio signal processing apparatus may analyze the sparseness of the matrix T and the matrix D, and perform binaural rendering using a matrix having the higher sparseness. That is, if the matrix T has the higher sparseness, the audio signal processing apparatus may perform binaural rendering on the converted audio signal Y. However, if the matrix D has the higher sparseness, the audio signal processing apparatus may perform binaural rendering on the input audio signal X.

When the matrix T and the matrix D change in real time, the audio signal processing apparatus may switch the binaural rendering on the audio signal Y and the binaural rendering on the audio signal X. In this case, in order to prevent sudden switching, the audio signal processing apparatus may perform the switching by using a fade-in/fade-out window or applying a smoothing factor.

Figure 3:
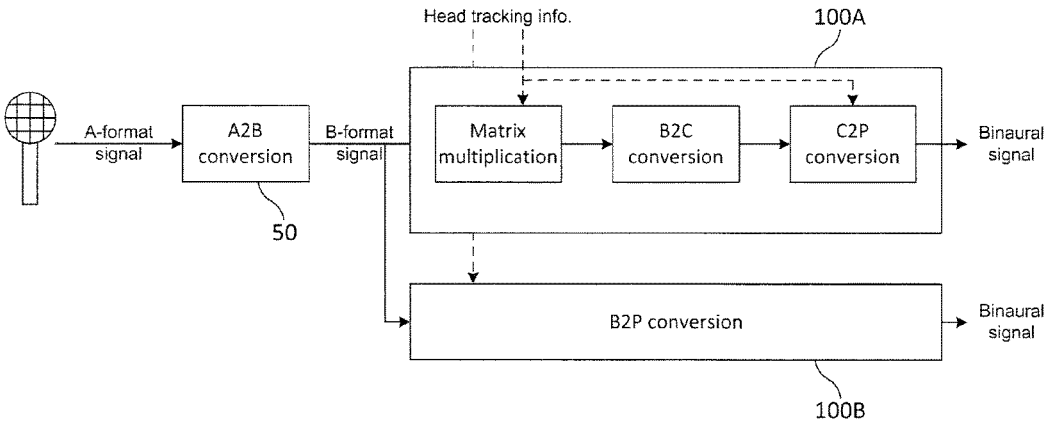
FIG. 3 illustrates a process in which a binaural signal is obtained from a signal recorded through a spherical microphone array.

FIG. 3 illustrates a process in which a binaural signal is obtained from a signal recorded through a spherical microphone array. The format converter 50 may convert a microphone array signal (i.e., an A-format signal) into an ambisonic signal (i.e., a B-format signal) through the aforementioned A2B conversion process. The audio signal processing apparatus may perform binaural rendering on ambisonic signals through various embodiments described above or a combination thereof.

A binaural renderer 100A according to the first embodiment of the present invention performs binaural rendering on the ambisonic signal using a B2C conversion and a C2P conversion. The C2P conversion refers to a conversion from a channel signal to a binaural signal. The binaural renderer 100A may receive head tracking information reflecting movement of a head of a listener, and may perform matrix multiplication for rotation transform of the B-format signal based on the information. As described above, the binaural renderer 100A may determine the B2C conversion matrix based on the rotation transform information. The B-format signal is converted to a virtual channel signal or an actual loudspeaker channel signal using the B2C conversion matrix. Next, the channel signal is converted to the final binaural signal through the C2P conversion.

Meanwhile, a binaural renderer 100B according to the second embodiment of the present invention may perform binaural rendering on the ambisonic signal using the B2P conversion. The B2P conversion refers to a direct conversion from a B-format signal to a binaural signal. That is, the binaural renderer 100B directly converts the B-format signal into a binaural signal without a process of converting it into a channel signal.

Figure 4:
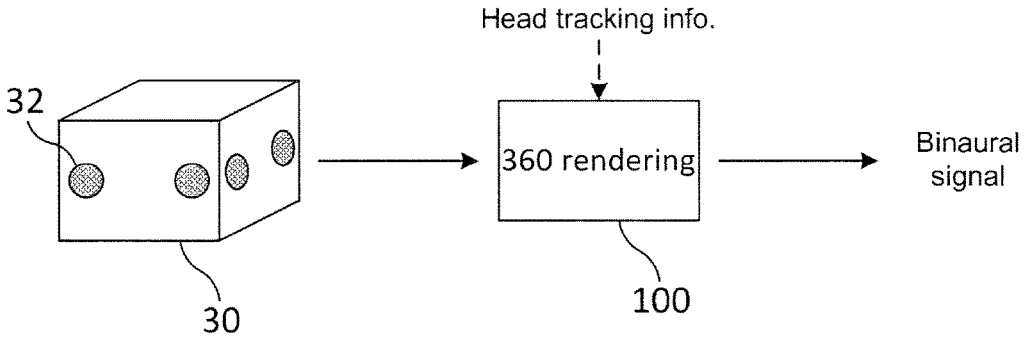
FIG. 4 illustrates a process in which a binaural signal is obtained from a signal recorded through a binaural microphone array.

FIG. 4 illustrates a process in which a binaural signal is obtained from a signal recorded through a binaural microphone array. A binaural microphone array 30 may be composed of 2N microphones 32 existing on a horizontal plane. According to an embodiment, each microphone 32 of the binaural microphone array 30 may be arranged with a pinna model depicting the shape of the external ear. Accordingly, each microphone 32 of the binaural microphone array 30 can record an acoustic signal as a signal to which an HRTF is applied. The signal recorded through the pinna model is filtered by the reflection, scattering, and the like of the sound wave due to the structure of the pinna. When the binaural microphone array 30 is composed of 2N microphones 32, N-points (i.e., N directions) of sound scenes can be recorded. When N is 4, the binaural microphone array 30 may record 4 sound scenes with azimuth intervals of 90 degrees.

The binaural renderer 100 generates a binaural signal using sound scene information received from the binaural microphone array 30. In this case, the binaural renderer 100 may perform an interactive binaural rendering (i.e., a 360 rendering) using head tracking information. However, since the input sound scene information is limited to the N-points, interpolation using 2N microphone input signals is required to render a sound scene corresponding to the azimuths between them. In addition, since only the sound scene information corresponding to the horizontal plane is received as input, a separate extrapolation should be performed to render an audio signal corresponding to a specific altitude angle.

Figure 5:
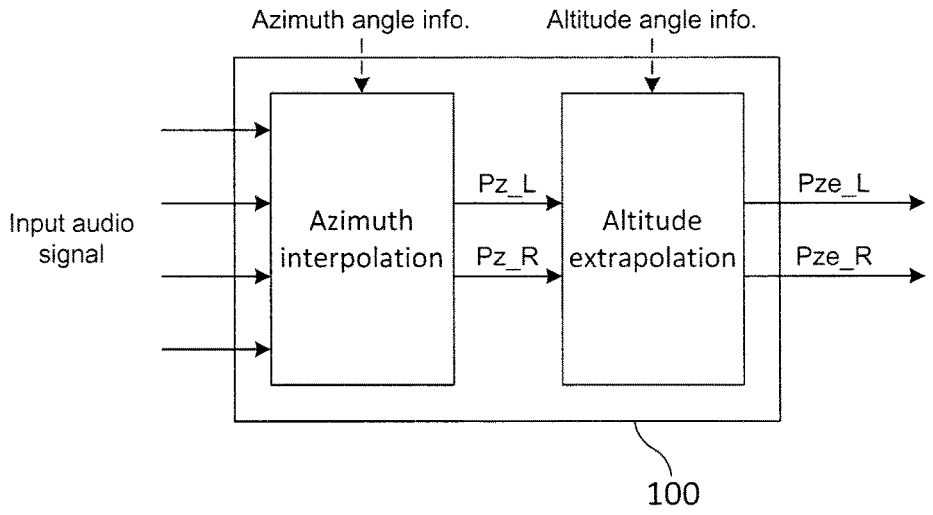
FIG. 5 illustrates a detailed embodiment for generating a binaural signal using a sound scene recorded through a binaural microphone array.

FIG. 5 illustrates a detailed embodiment for generating a binaural signal using a sound scene recorded through a binaural microphone array. According to the embodiment of the present invention, the binaural renderer 100 may generate a binaural signal through an azimuth interpolation and an altitude extrapolation of an input sound scene.

First, the binaural renderer 100 may perform the azimuth interpolation of the input sound scene based on azimuth information. According to an embodiment, the binaural renderer 100 may perform power panning of the input sound scene to signals of the nearest two points. More specifically, the binaural renderer 100 obtains head orientation information of a listener and determines the first point and the second point corresponding to the head orientation information. Next, the binaural renderer 100 may project the head orientation of the listener to the plane of the first point and the second point, and determine interpolation coefficients by using each distance from the projected position to the first point and the second point. The binaural renderer 100 performs azimuth interpolation using the determined interpolation coefficients. Through such an azimuth interpolation, the power-panned output signals Pz_L and Pz_R may be generated.

Next, the binaural renderer 100 may additionally perform the altitude extrapolation based on altitude angle information. The binaural renderer 100 may perform filtering on the azimuth interpolated signals Pz_L and Pz_R using parameters corresponding to an altitude angle e to generate output signals Pze_L and Pze_R reflecting the altitude angle e. According to an embodiment, the parameters corresponding to the altitude angle e may include notch and peak values corresponding to the altitude angle e.

The detailed described embodiments of the present invention may be implemented by various means. For example, the embodiments of the present invention may be implemented by a hardware, a firmware, a software, or a combination thereof.

In case of the hardware implementation, the method according to the embodiments of the present invention may be implemented by one or more of Application Specific Integrated Circuits (ASICSs), Digital Signal Processors (DSPs), Digital Signal Processing Devices (DSPDs), Programmable Logic Devices (PLDs), Field Programmable Gate Arrays (FPGAs), processors, controllers, micro-controllers, micro-processors, and the like.

In case of the firmware implementation or the software implementation, the method according to the embodiments of the present invention may be implemented by a module, a procedure, a function, or the like which performs the operations described above. Software codes may be stored in a memory and operated by a processor. The processor may be equipped with the memory internally or externally and the memory may exchange data with the processor by various publicly known means.

The description of the present invention is used for exemplification and those skilled in the art will be able to understand that the present invention can be easily modified to other detailed forms without changing the technical idea or an essential feature thereof. Thus, it is to be appreciated that the embodiments described above are intended to be illustrative in every sense, and not restrictive. For example, each component described as a single type may be implemented to be distributed and similarly, components described to be distributed may also be implemented in an associated form.

The scope of the present invention is represented by the claims to be described below rather than the detailed description, and it is to be interpreted that the meaning and scope of the claims and all the changes or modified forms derived from the equivalents thereof come within the scope of the present invention.

The invention claimed is:

1. An audio signal processing apparatus, the apparatus comprising:

a pre-processor configured to separate an input audio signal into a first component corresponding to at least one object signal and a second component corresponding to a residual signal and extract position vector information corresponding to the first component from the input audio signal, wherein the input audio signal comprises higher order ambisonics (HOA) coefficients, and wherein the position vector information is obtained by decomposing the HOA coefficients into a first matrix representing a plurality of audio signals and a second matrix representing position vector information of each of the plurality of audio signals;

a first rendering unit configured to perform an object-based first rendering on the first component using position vector information of the second matrix corresponding to the first component; and a second rendering unit configured to perform a channel-based second rendering on the second component, wherein the first component is extracted from audio signals having a level equal to or higher than a threshold value among the plurality of audio signals represented by the first matrix.

2. The apparatus of claim 1, wherein the pre-processor performs a matrix decomposition of the HOA coefficients using singular value decomposition (SVD).

3. The apparatus of claim 1, wherein the first rendering is an object-based binaural rendering, and wherein the first rendering unit performs the first rendering using a head related transfer function (HRTF) based on the position vector information corresponding to the first component.

4. The apparatus of claim 1, wherein the second rendering is a channel-based binaural rendering, and wherein the second rendering unit maps the second component to at least one virtual channel and performs the second rendering using an HRTF based on the mapped virtual channel.

5. The apparatus of claim 1, wherein the first rendering unit performs the first rendering by referring to spatial information of at least one object obtained from a video signal corresponding to the input audio signal.

6. The apparatus of claim 5, wherein the first rendering unit modifies at least one parameter related to the first component based on the spatial information obtained from the video signal, and performs an object-based rendering on the first component using the modified parameter.

7. An audio signal processing method, the method comprising:

separating an input audio signal into a first component corresponding to at least one object signal and a second component corresponding to a residual signal, wherein the input audio signal comprises higher order ambisonics (HOA) coefficients;

extracting position vector information corresponding to the first component from the input audio signal, wherein the position vector information is obtained by decomposing the HOA coefficients into a first matrix representing a plurality of audio signals and a second matrix representing position vector information of each of the plurality of audio signals;

performing an object-based first rendering on the first component using position vector information of the second matrix corresponding to the first component; and performing a channel-based second rendering on the second component, wherein the first component is extracted from audio signals having a level equal to or higher than a threshold value among the plurality of audio signals represented by the first matrix.

8. The method of claim 7, further comprising performing a matrix decomposition of the HOA coefficients using singular value decomposition (SVD).

9. The method of claim 7, wherein the first rendering is an object-based binaural rendering, and wherein the first rendering is performed using a head related transfer function (HRTF) based on the position vector information corresponding to the first component.

10. The method of claim 7, wherein the second rendering is a channel-based binaural rendering, and wherein the second rendering is performed by mapping the second component to at least one virtual channel and using an HRTF based on the mapped virtual channel.

11. The method of claim 7, wherein the first rendering is performed by referring to spatial information of at least one object obtained from a video signal corresponding to the input audio signal.

12. The method of claim 11, wherein performing the first rendering further comprises:

modifying at least one parameter related to the first component based on the spatial information obtained from the video signal; and performing an object-based rendering on the first component using the modified parameter.

13. An audio signal processing apparatus, the apparatus comprising:

a pre-processor configured to separate an input audio signal into a first component corresponding to at least one object signal and a second component corresponding to a residual signal and extract position vector information corresponding to the first component from the input audio signal, wherein the input audio signal comprises higher order ambisonics (HOA) coefficients, and wherein the position vector information is obtained by decomposing the HOA coefficients into a first matrix representing a plurality of audio signals and a second matrix representing position vector information of each of the plurality of audio signals;

a first rendering unit configured to perform an object-based first rendering on the first component using position vector information of the second matrix corresponding to the first component; and a second rendering unit configured to perform a channel-based second rendering on the second component, wherein the first component is extracted from coefficients of a predetermined low order among the HOA coefficients.

14. The apparatus of claim 13, wherein the pre-processor performs a matrix decomposition of the HOA coefficients using singular value decomposition (SVD).

15. The apparatus of claim 13, wherein the first rendering is an object-based binaural rendering, and wherein the first rendering unit performs the first rendering using a head related transfer function (HRTF) based on the position vector information corresponding to the first component.

16. The apparatus of claim 13, wherein the second rendering is a channel-based binaural rendering, and wherein the second rendering unit maps the second component to at least one virtual channel and performs the second rendering using an HRTF based on the mapped virtual channel.

17. The apparatus of claim 13, wherein the first rendering unit performs the first rendering by referring to spatial information of at least one object obtained from a video signal corresponding to the input audio signal.

18. The apparatus of claim 17, wherein the first rendering unit modifies at least one parameter related to the first component based on the spatial information obtained from the video signal, and performs an object-based rendering on the first component using the modified parameter.

19. An audio signal processing method, the method comprising:

separating an input audio signal into a first component corresponding to at least one object signal and a second component corresponding to a residual signal, wherein the input audio signal comprises higher order ambisonics (HOA) coefficients;

extracting position vector information corresponding to the first component from the input audio signal, wherein the position vector information is obtained by decomposing the HOA coefficients into a first matrix representing a plurality of audio signals and a second matrix representing position vector information of each of the plurality of audio signals;

performing an object-based first rendering on the first component using position vector information of the second matrix corresponding to the first component; and performing a channel-based second rendering on the second component, wherein the first component is extracted from coefficients of a predetermined low order among the HOA coefficients.

20. The method of claim 19, further comprising performing a matrix decomposition of the HOA coefficients using singular value decomposition (SVD).

21. The method of claim 19, wherein the first rendering is an object-based binaural rendering, and wherein the first rendering is performed using a head related transfer function (HRTF) based on the position vector information corresponding to the first component.

22. The method of claim 19, wherein the second rendering is a channel-based binaural rendering, and wherein the second rendering is performed by mapping the second component to at least one virtual channel and using an HRTF based on the mapped virtual channel.

23. The method of claim 19, wherein the first rendering is performed by referring to spatial information of at least one object obtained from a video signal corresponding to the input audio signal.

24. The method of claim 23, wherein performing the first rendering further comprises:

modifying at least one parameter related to the first component based on the spatial information obtained from the video signal; and performing an object-based rendering on the first component using the modified parameter.

* * * * *